US006792796B2

(12) United States Patent
Hammonds

(10) Patent No.: US 6,792,796 B2
(45) Date of Patent: Sep. 21, 2004

(54) SCALE PREDICTION PROBE

(75) Inventor: Paul Hammonds, Midmar (GB)

(73) Assignee: Baker Hughes Incorporated, Houston, TX (US)

( * ) Notice: Subject to any disclaimer, the term of this patent is extended or adjusted under 35 U.S.C. 154(b) by 69 days.

(21) Appl. No.: 09/754,792

(22) Filed: Jan. 3, 2001

(65) Prior Publication Data

US 2001/0052414 A1 Dec. 20, 2001

Related U.S. Application Data

(60) Provisional application No. 60/175,088, filed on Jan. 7, 2000.

(51) Int. Cl.[7] ..... G01N 17/00

(52) U.S. Cl. ..... 73/86; 166/250.05; 427/255.23

(58) Field of Search ..... 73/86; 166/250.05; 427/255.23

(56) References Cited

U.S. PATENT DOCUMENTS

| | | | | | |
|---|---|---|---|---|---|
| 3,951,161 | A | * | 4/1976 | Rohrback et al. | 137/3 |
| 4,351,715 | A | * | 9/1982 | Matsuzaki et al. | 204/634 |
| 4,665,981 | A | | 5/1987 | Hayatdavoudi | |
| 4,856,584 | A | | 8/1989 | Seidner | |
| 5,865,966 | A | * | 2/1999 | Watanabe et al. | 204/278.5 |
| 6,056,878 | A | * | 5/2000 | Tessier et al. | 204/524 |
| 6,296,751 | B1 | * | 10/2001 | Mir | 204/524 |
| 6,337,102 | B1 | * | 1/2002 | Forrest et al. | 427/255.23 |

OTHER PUBLICATIONS

A. Neville, et al., "Surface Scales in Sea Water Systems: Effects of Their Formation on Corrosion Behavior of Engineering Steels," British Corrosion Journal, 1997, pp. 277–282, vol. 32, No. 4.

A. P. Morizot, et al., "Electrochemical Aspects of Surface/Solutions Interactions in Scale Inhibition and Growth," Corrosion 98, 1998, pp. 65/1–65/18, Paper No. 65.

A. Neville, et al., "Electrochemical Assessment of Calcium Carbonate Deposition Using a Rotating Disc Electrode (RDE)," Journal of Applied Electrochemistry, 1999, pp. 455–462, vol. 29.

A. Morizot, et al., "Studies of the Deposition of CaCO3 on a Stainless Steel Surface by a Novel Electrochemical Technique," Journal of Crystal Growth, 1999, pp. 738–743, 198/199.

A. P. Morizot, et al., "Investigation of Barium Sulphate Deposition and Precipitation Using a Novel Approach," Corrosion 99, 1999, pp. 1–13, Paper No. 113

A.P. Morizol, et al., "A Novel Approach for Monitoring of CaCO3 and BaSo4 Scale Formation," Second International Symposioum on Oilfield Scale, Jan. 26–27, 2000, pp. 1–6, SPE 60189, Aberdeen, UK, [NOTE: This article is too recent to be prior art and is provided in an abundance of caution.].

A. P. Morizot, et al., "A Study of Inhibitor Film Formation Using an Electrochemical Technique," Corrosion 2000, 2000, pp. 00108/1–00108/12, Paper No. 00108. [NOTE: This article is too recent to be prior art and is provided in an abundance of caution.].

* cited by examiner

*Primary Examiner*—Hezron Williams
*Assistant Examiner*—André K. Jackson
(74) *Attorney, Agent, or Firm*—Madan, Mossman & Sriram, P.C.

(57) ABSTRACT

A method for predicting scale deposition in a general environment has been discovered which involves providing a localized environment where scale would preferentially form, where the localized environment is adjacent the general environment. Monitoring the deposition of scale in the localized environment is performed for the purpose of taking preemptive action to prevent scale deposition in the general environment once scale begins to form, or a certain threshold is reached. Scale is removed from the localized environment so that monitoring can be performed by the probe again. Preemptive action will often be the introduction of a scale inhibiting agent into the general environment. An apparatus for practicing the method of predicting and preventing scale deposition in a general environment is also described.

7 Claims, 2 Drawing Sheets

*Electrode configuration for calcium carbonate scale sensor*

Electrode configuration for calcium carbonate scale sensor

SCALE PREDICTION PROBE

This application claims the benefit of provisional application 60/175088, filed Jan. 7,2000.

FIELD OF THE INVENTION

The present invention relates to methods and apparatus for detecting and preventing undesirable scale deposition, and more particularly relates, in one embodiment, to methods and apparatus for detecting and preventing undesirable scale deposition that employ electrodes which intentionally cause scale deposition as a diagnostic indicator.

BACKGROUND OF THE INVENTION

The accumulation of inorganic mineral scales in oil field formation and production equipment is a major problem for the oil industry. Deposition of inorganic mineral scale in oil-bearing formations and on production tubing and equipment causes significant and costly loss of production. Other industries have similar problems with scale deposition. The primary offenders are carbonates and sulfates of calcium, barium and strontium. These compounds may precipitate as a result of changes in pressure, temperature and ionic strength of produced fluids or when connate reservoir waters mix with injected waters during secondary recovery operations. In order to avoid costly losses in production or post-scale treatments, it is necessary to prevent deposition of scale downhole as well as in post production processing. Scale is a particular problem when equipment is in contact with certain brines.

Current scale probes indicate the onset of scale deposition. However, in order to take preventive action, an advance sensor is required which detects the onset of scaling conditions before actual scale deposition occurs on the surfaces to be protected. The advantage of such a sensor would be that time for preventive measures is gained and the need for remedial work is avoided. It would be advantageous if a scale prediction probe could be devised which would be able to determine conditions just prior to when undesirable scaling would occur.

SUMMARY OF THE INVENTION

Accordingly, it is an object of the present invention to provide a method and apparatus for preventing scale from forming on surfaces, particularly oil field production equipment.

It is another object of the present invention to provide a scale prediction probe which would be able to determine conditions just prior to those under which undesirable scaling would occur.

In carrying out these and other objects of the invention, there is provided, in one form, a method for predicting scale deposition in a general environment which involves providing a localized environment where scale is preferentially formed first (relative to the general environment), where the localized environment is adjacent the general environment, and monitoring the deposition of scale in the localized environment. Preemptive action may thus be taken to prevent scale deposition in the general environment in response to the results obtained from monitoring the deposition of scale. Finally, the intentionally formed scale is removed from the localized environment so the method can be practiced again.

DETAILED DESCRIPTION OF THE INVENTION

The scale prediction probe of the present invention provides a surface that will preferentially scale over before any other surface in the general area. Stated another way, scale-forming conditions are intentionally caused to be formed in a localized environment adjacent a general environment so that scale forms on that localized environment or surface before any other surface in the general environment has scale deposited thereon. Further, the degree of "over scaling potential" may be controlled and remotely adjusted to suit individual conditions.

It may thus be understood that the inventive scale prediction probe may be used to predict, and thus prevent, the deposition of undesirable scale in the general environment. It should be recognized that this concept of prediction is different from that used by some researchers where "predict" is used to mean being able to accurately measure the amount of scale formed on a surface.

Two probe embodiments form the basis of the invention. The first embodiment uses an inert electrode with a controlled surface pH, and the second embodiment is a dual surface probe where one area generates a controlled release of sulfate ions, for example, and the second surface acts as the scale collector. The first embodiment is for the prediction of calcium carbonate scale deposition and the like, in one non-limiting case, while the second embodiment is for barium and strontium sulfate scale deposition prevention, in other non-limiting cases.

During cathodic protection in sea water and other saline solutions (brines) the cathodic surface becomes coated with scale in preference to nearby non-cathodic surfaces. This scale deposition is induced due to the electrical generation of alkaline conditions at the electrode surface. This high surface pH can be caused as described below. The effect of the localized increased pH is to drive the scaling reaction such as that depicted below:

$$Ca^{2+}+2HCO_3^- \leftrightharpoons CaCO_3\downarrow+CO_2+H_2O$$

The increase in alkalinity of the electrode surface is generated by an applied electric current. This current may be controlled either galvanostatically, potentiostatically, or may have some time-dependent voltage/current control. The electrode may be of the same or different material as the system, but should not generate scaling species. Carbon steel may be appropriate in some conditions due to the cathodic polarization induced by the recording and stimulating equipment. Preferably, the electrode is an inert electrode material such as platinum-plated or platinum-coated titanium. However, the invention is not limited to any particular metal for the electrodes.

Figure 1:
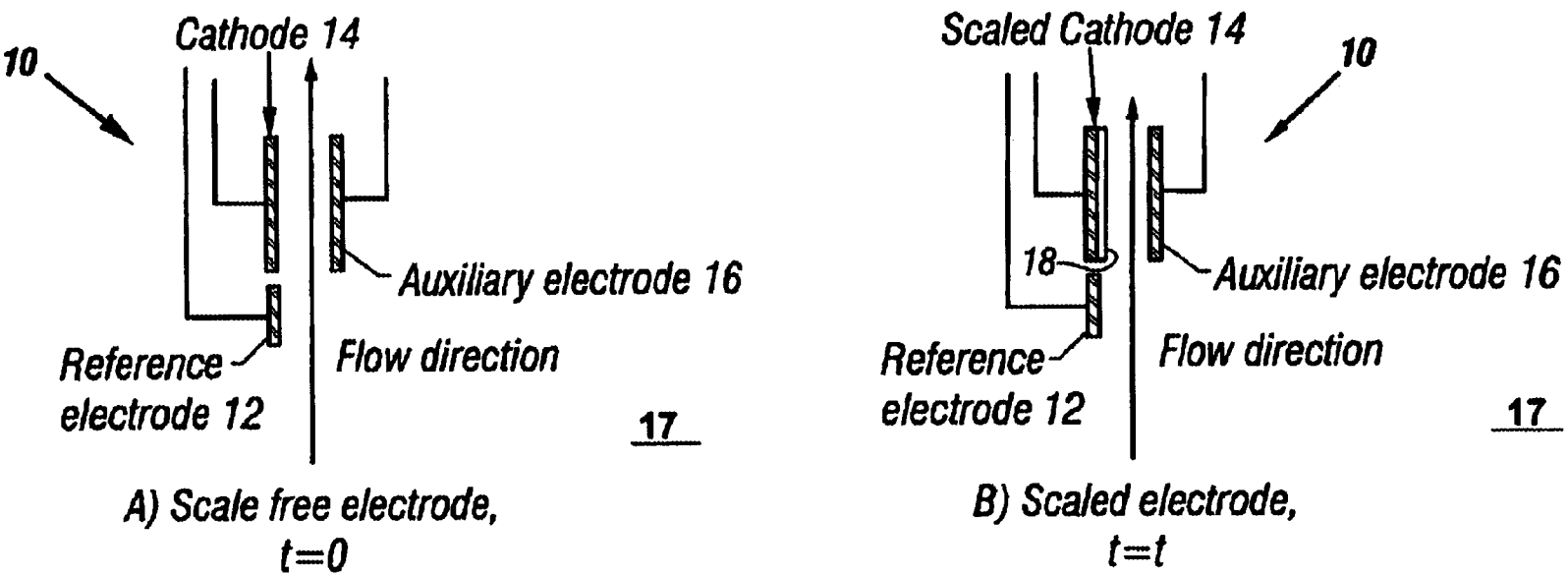
FIG. 1 is a schematic diagram of an electrode configuration for a calcium carbonate scale sensor in accordance with the apparatus and method of this invention, where FIG. 1A schematically shows a scale free electrode at time t=0, and where FIG. 1B schematically shows a scaled cathode at a later time t=t.

FIG. 1 provides a schematic diagram of the principal parts of the invention; however, it would be appreciated that the actual configuration used in practice would depend on the individual system in which the sensor would be installed. The electrode configuration or apparatus for the calcium carbonate scale inhibitor of FIG. 1 is generally referred to as 10, where the reference electrode 12 may be positioned adjacent the cathode 14 which is opposite and adjacent (in another, facing direction) the auxiliary electrode 16 having fluid flow in the direction indicated. Note the cathode 14 and anode 16 are downstream from the reference electrode 12. The reference electrode 12 is used to measure the electrical potential of the cathodic or working electrode 14. Measurements taken by reference electrode 12 are used by the instrumentation to control the potential/current applied by the auxiliary electrode 16 on the cathodic (working) electrode 14. Reference electrode 12 also provides a fixed point of reference for comparison of electrochemical potentials in other systems (where a recognized standard reference electrode is utilized).

FIG. 1A shows the apparatus 10 at some initial time, t=0, where cathode 14 is scale-free. FIG. 1B shows the apparatus 10 at some later time, t=t, where the cathode 14 has scale 18 deposited thereon. It will be appreciated that the early detection of carbonate scales other than calcium carbonate could be achieved by the method and apparatus of this embodiment. It will also be appreciated that cathode 14 and anode 16 make up the localized environment in one embodiment of the invention. The localized environment is adjacent the general environment 17. Generating the applied electric current across cathode 14 and anode 16 conditions the cathode 14 to be slightly more scaling than the bulk fluid.

Figure 2:
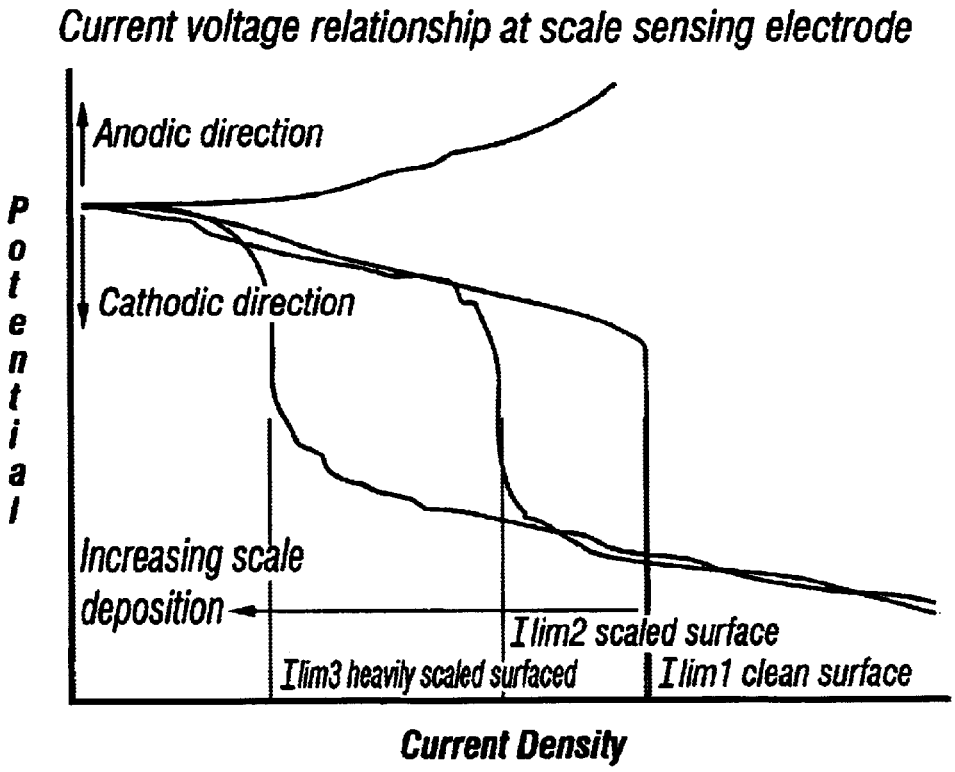
FIG. 2 is a graph of voltage potential v. current density in a current/voltage relationship at the scale sensing electrode of this invention under various conditions.

The measurement of intentional scale build-up on the electrode depends upon the detection of the diffusion limited current due to the reduction of a suitable species in the electrolyte. For example, in sea water, oxygen is reduced to hydroxyl ion, and diffusion of the gas to the electrode surface is increasingly limited by the build-up of scale. This results in a diffusion-limiting current at the electrode surface. FIG. 2 shows the effect of scale build-up on the current voltage relationship at the electrode surface. The values of the diffusion limiting currents (I lim 1, I lim 2, and I lim 3) are given at three different times or scale levels, with scale increasing on the cathode in the direction right to left in FIG. 2. That is, I lim decreases with time as scale is formed on the electrode. FIG. 2 is an example of how the curve would move with time.

The diffusion limited current may be detected by electrochemical methods other than the full potential sweep shown in FIG. 2, such as electrochemical impedence measurements and current potential logging, as non-limiting examples among others. In essence, impedence measures the response of the working electrode to a varying applied potential frequency in terms of electrical impedence. Current potential logging measures the current passing between two electrodes and the potential of the electrodes. This data is then statistically analyzed.

The surface pH is dependent upon the cathodic current density and the rate of diffusion of alkaline species away from the electrode and the rate of diffusion of acidic species toward the electrode. If the temperature, surface geometry, current density and flow characteristics of the brine or other fluid are known, then by using Fick's laws of diffusion and basic chemical/electrochemical equations, the surface pH may be calculated. Control of the surface pH is less accurate using calculated values from diffusion laws (e.g. Fick's law) due to variability of hydrodynamics, etc., and would only be used as a "sighting shot" or to determine approximate settings for obtaining empirical data. Alternatively, control values may be obtained from experimental data and used for other conditions by interpolation or extrapolation.

If the auxiliary and working (cathode or sensing) electrode are identical, then they may be interchanged, or the auxiliary may be used as a blank scale reference/normal scaling potential reference. An additional benefit of this technique is that electrode cleaning of a scaled surface is possible by applying a high current density to the electrode that has the effect of generating gas bubbles that disrupt and remove the scale from the electrode surface. Thus, the electrode surface can be used for accurate monitoring again.

As the presence of scale is detected through reduction in current density as shown, the scale prediction probe can give a signal for the release of a certain, predetermined amount or rate of scale inhibiting chemical or agent into the fluid of the system. This step may be initiated when the current density falls below a certain preset threshold. Such a preset threshold would be individual for each system and could not be specified in general or in advance. By injecting scale inhibiting agents or chemicals only when needed, conservation of the agent and costs associated therewith can be achieved. Scale inhibiting chemicals and agents are well known in the art. Additionally, the use of injection mechanisms such as nozzles, pipes, needles, and the like are also well known in the art. Similarly, the removal of scale by applying a high current density to the electrode as described above could also be triggered or caused once the current density falls below a certain preset threshold.

In the embodiment for barium and strontium sulfate scale deposition, one change to the above embodiment is there is present an additional surface suitable to generate a controlled release of sulfate ions.

The formation of sulfate-containing scales is not strongly affected by pH, and thus the above embodiment cannot create an increased scaling tendency for these scale types. However, by the introduction of a local excess of sulfate ion (barium or strontium, for example, where appropriate), over the bulk concentration of these ions, then the local scaling tendency will be increased. This latter technique is the basis of the sulfate scaling tendency embodiment of the invention.

Figure 3:
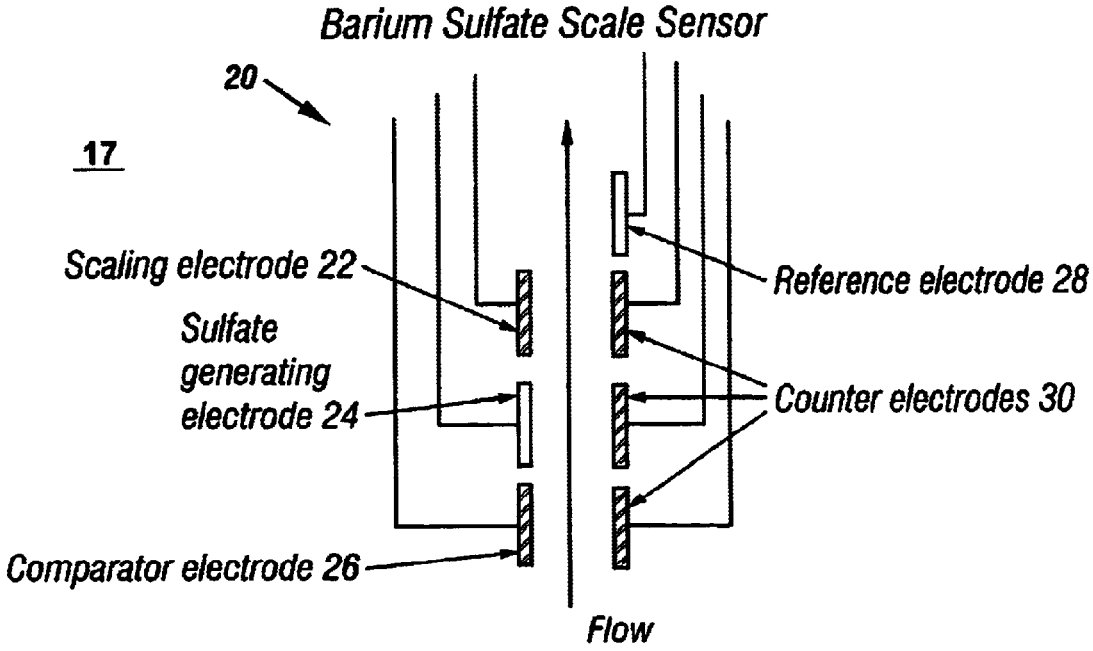
FIG. 3 is a schematic diagram of an electrode configuration for a barium sulfate or strontium sulfate scale sensor in accordance with the apparatus and method of this invention.

Shown in FIG. 3 is a schematic diagram of an electrode configuration for a barium sulfate or strontium sulfate scale sensor. The electrode configuration is generally denoted as 20. The detecting or scaling electrode 22 (corresponding to the cathode 14 in the carbonate scale detection embodiment) is immediately down stream of a sulfate generating electrode 24, the sole purpose of which is to generate a controlled excess of scaling ion (sulfate, barium, strontium, etc.). This excess ion then drifts over the sensing electrode 22 (i.e. the working electrode, as in the previously described embodiment) and causes deposition when the bulk fluids are close to saturation with respect to the scale being deposited on the sensing/detecting electrode 22.

The comparator electrode 26 shown in FIG. 2 is similar to the sensing electrode 22 down stream of the generating electrodes and serve the purpose of determining if the actual system is in a scaling condition without the presence of the excess ions supplied by electrode 24. Counter electrodes 30 serve the function of auxiliary electrodes 16 in the FIG. 1 embodiment.

The generation of sulfate, barium or strontium scaling ions for producing an excess scaling tendency is necessary for the second embodiment, for without it, the electrode sensor 22 will only detect scale at the same time the entire system experiences the onset of scaling.

In the foregoing specification, the invention has been described with reference to specific embodiments thereof. However, it will be evident that various modifications and changes can be made thereto without departing from the broader spirit or scope of the invention as set forth in the appended claims. Accordingly, the specification is to be regarded in an illustrative rather than a restrictive sense. For example, scales other than those specifically mentioned, and electrode configurations other than those specifically shown and described, falling within the claimed parameters, but not specifically identified or tried in a particular application to inhibit scale formation, are within the scope of this invention.

I claim:

1. An apparatus for preventing scale deposition in a general environment where scale may form, comprising:

a) a cathode in the general environment to locally and electrically generate alkaline conditions as a localized environment for the preferential deposition of scale on the cathode;

b) a device to measure the extent of scale deposition on the cathode; and c) a device to prevent or remove scale from surfaces in the general environment adjacent the electrode in response to the extent of scale deposition exceeding a preset threshold.

2. The apparatus of claim 1 where the b) device to measure the extent of scale deposition on the cathode further comprises an auxiliary anode spaced apart from the cathode such that the current density between them may be measured.

3. The apparatus of claim 1 further comprising d) a reference electrode upstream from the cathode.

4. The apparatus of claim 1 where the c) device to prevent or remove scale comprises a mechanism to inject a scale inhibiting agent into the general environment.

5. The apparatus of claim 1 further comprising e) an ion-generating device, where the ion is a component of the scale to be prevented.

6. The apparatus of claim 5 where the e) ion-generating device generates an ion selected from the group consisting of sulfate, barium and strontium.

7. The apparatus of claim 5 where the e) ion-generating device is upstream of the cathode, and the apparatus further comprises f) a comparator electrode upstream of the ion-generating device to determine the ion content away from the ion-generating device.

* * * * *